US010836174B2

(12) United States Patent
Breen et al.

(10) Patent No.: US 10,836,174 B2
(45) Date of Patent: Nov. 17, 2020

(54) LATCH PROTECTOR

(71) Applicant: Hewlett-Packard Development Company, L.P., Houston, TX (US)

(72) Inventors: John Breen, Tipperary (IE); John McNeilly, Bray (IE); Kevin Lawlor, Dublin (IE); Cormac OBeirne, Galway (IE); Eugene Cahill, Kells (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/325,324

(22) PCT Filed: Sep. 9, 2016

(86) PCT No.: PCT/US2016/051003
§ 371 (c)(1),
(2) Date: Feb. 13, 2019

(87) PCT Pub. No.: WO2018/048416
PCT Pub. Date: Mar. 15, 2018

(65) Prior Publication Data
US 2019/0202207 A1 Jul. 4, 2019

(51) Int. Cl.
*B41J 2/175* (2006.01)

(52) U.S. Cl.
CPC ..... *B41J 2/1754* (2013.01); *B41J 2/17533* (2013.01); *B41J 2/17536* (2013.01)

(58) Field of Classification Search
CPC ..... B41J 2/17533; B41J 2/17536
See application file for complete search history.

(56) References Cited

U.S. PATENT DOCUMENTS

| | | | | |
|---|---|---|---|---|
| 6,623,104 | B1 * | 9/2003 | Kotaki | B41J 2/17513 347/49 |
| 6,637,863 | B2 | 10/2003 | Jones | |
| 7,566,112 | B2 | 7/2009 | Seino et al. | |
| 2003/0081087 | A1 | 5/2003 | Sakai et al. | |
| 2005/0018014 | A1 | 1/2005 | Butty et al. | |

FOREIGN PATENT DOCUMENTS

| | | |
|---|---|---|
| EP | 0822083 | 2/1998 |
| EP | 0829363 | 3/1998 |

OTHER PUBLICATIONS

Anita, Eco-cartridge—Recycled Cardbord Ink Cartridge Concept,http://www.envirogadget.com/recycling/eco-cartridge-recycled-cardbord-ink-cartridae-concept/(Nov. 8, 2010).

* cited by examiner

*Primary Examiner* — Jason S Uhlenhake
(74) *Attorney, Agent, or Firm* — Rathe Lindenbaum LLP

(57) ABSTRACT

A printing material supply may include a body to contain a printing material, a latch pivotably coupled to the body by a living hinge and a latch protector. The latch protector may include a structure coupled to and projecting from the body so as to contact a packaging surface of a package to inhibit creep of the latch about the living hinge when the printing material supply is contained within the packaging.

13 Claims, 10 Drawing Sheets

LATCH PROTECTOR

BACKGROUND

Printers often utilize removable cartridges, containers or supplies that provide printing material for printing. Some removable supplies include printing elements, such as a print head, to directly print upon the print medium. Other removal supplies include an outlet through which the printing material is supplied to a remote printing element. Many supplies further include a latch which retains the printing material supply in place during use in the printer.

9 is another front perspective view of the example printing material supply of 8.

Figure 8:
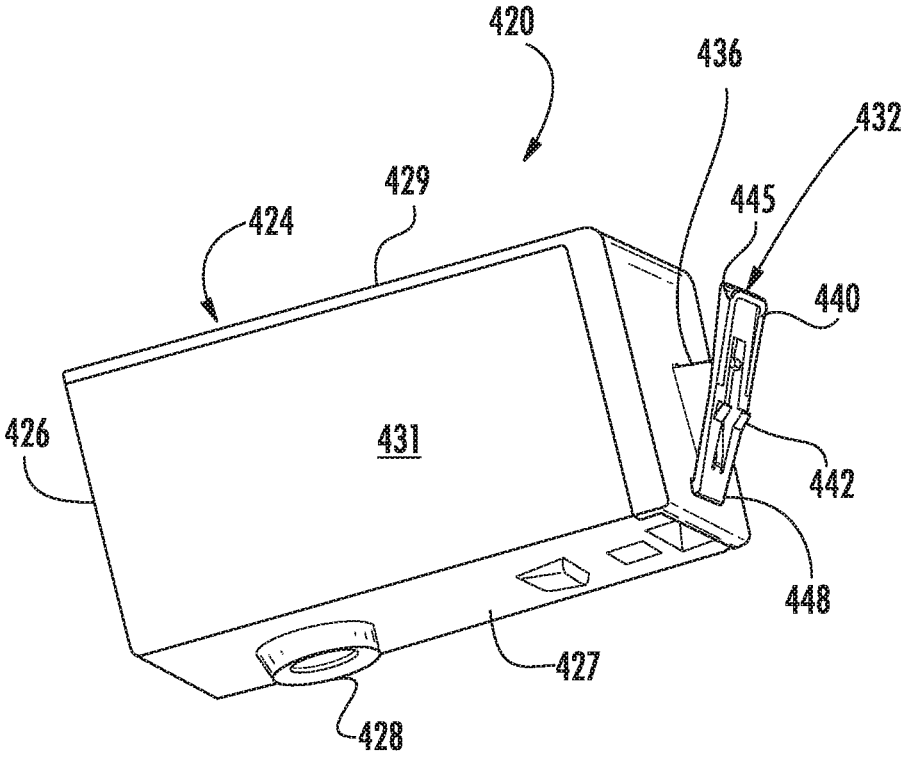
FIG. 8 is a front perspective view of an example printing material supply.
Figure 9:
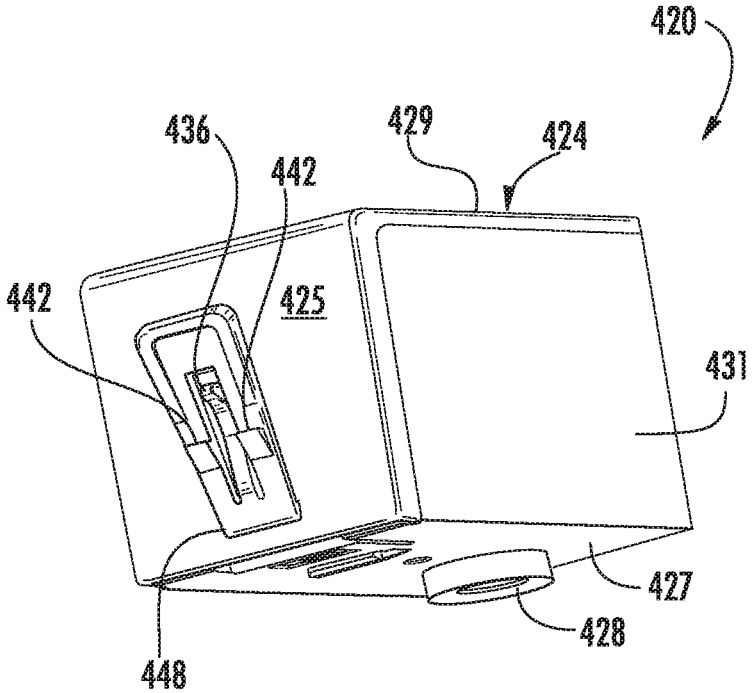

10 is a fragmentary top view of a portion of the printing material supply of FIG. 8.

Figure 10:
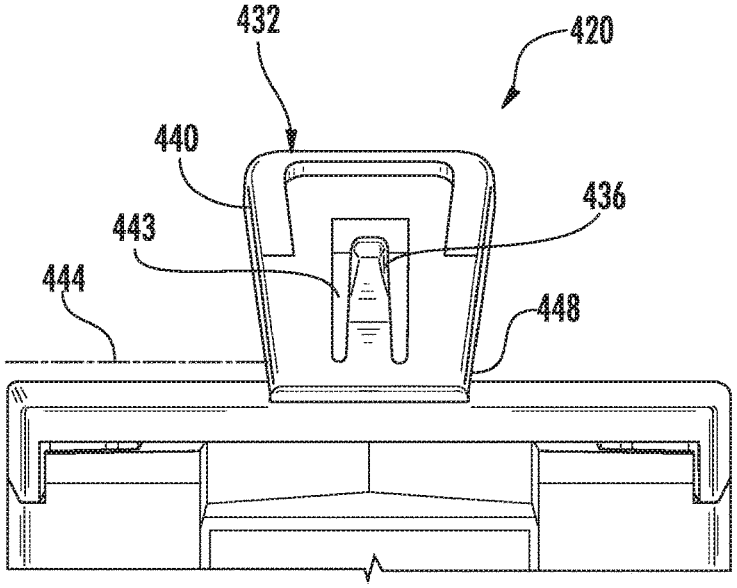
Figure 10A:
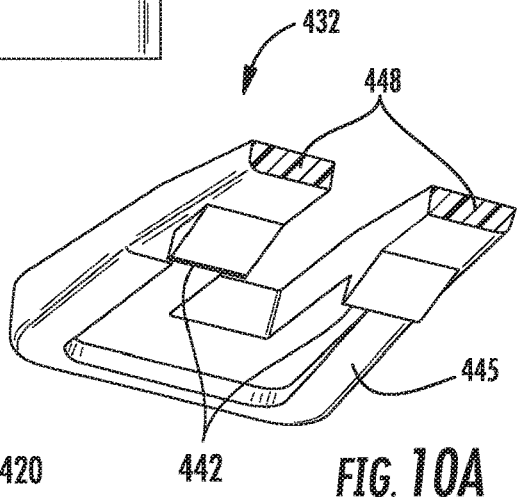

FIG. 10A is a sectional view taken through an example living hinge of the example printing material supply of FIG. 8.

Figure 11:
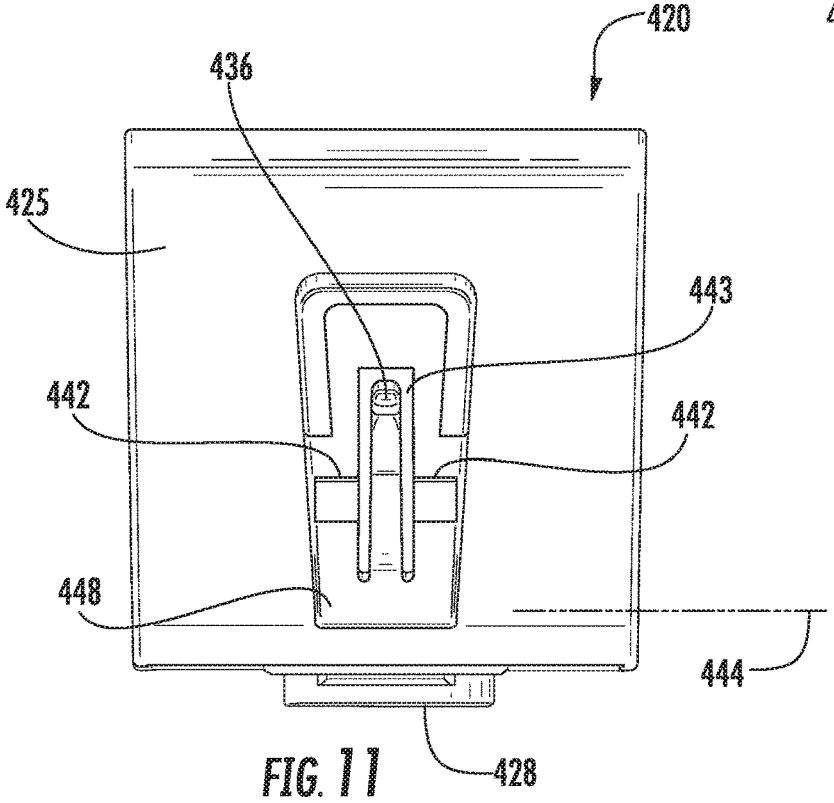

FIG. 11 is a front view of the example printing material supply of FIG. 8.

Figure 12:
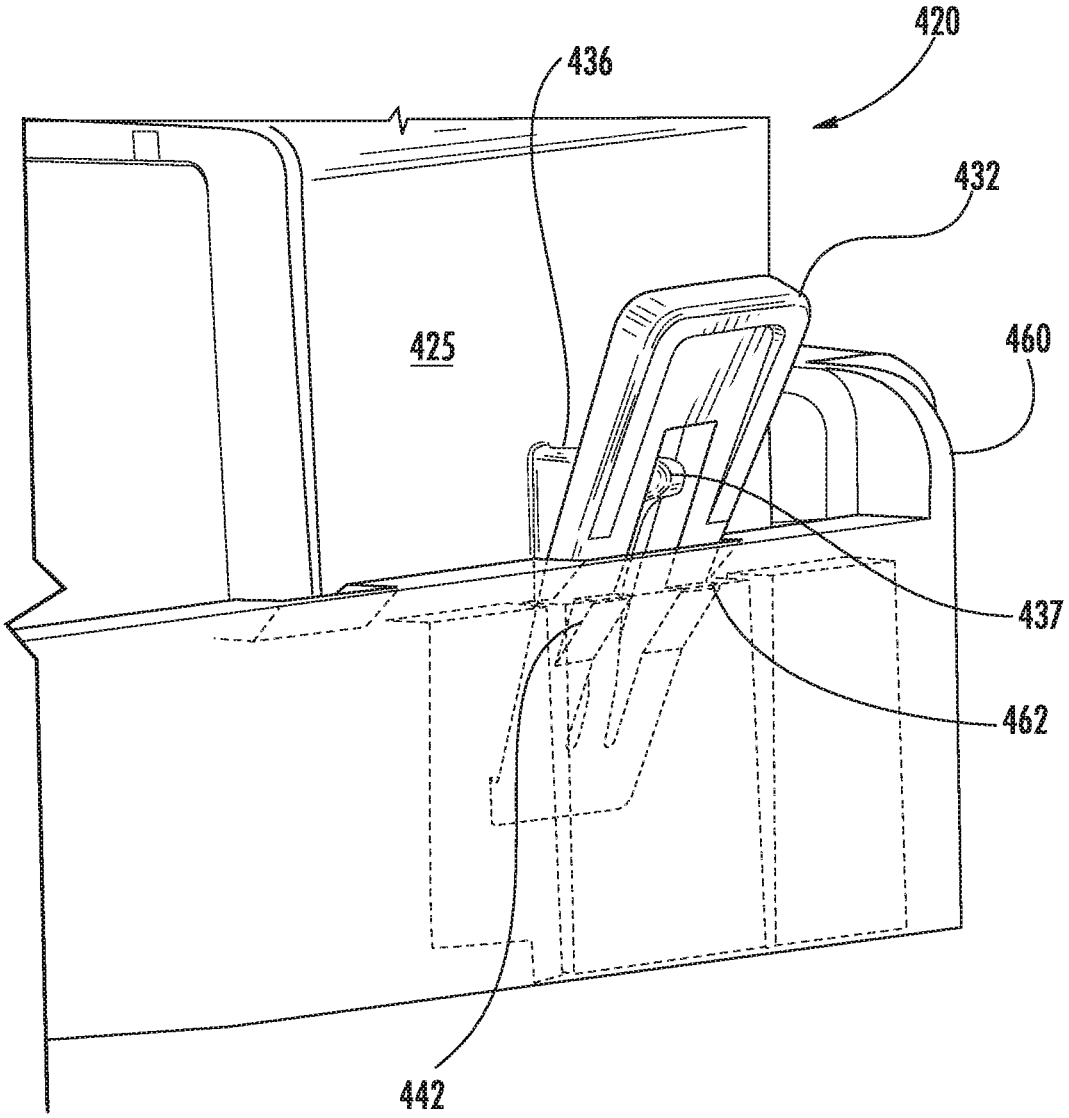

FIG. 12 is a fragmentary perspective view of the example printing material supply of 8 positioned within an example printer printing material supply bay.

Figure 13:
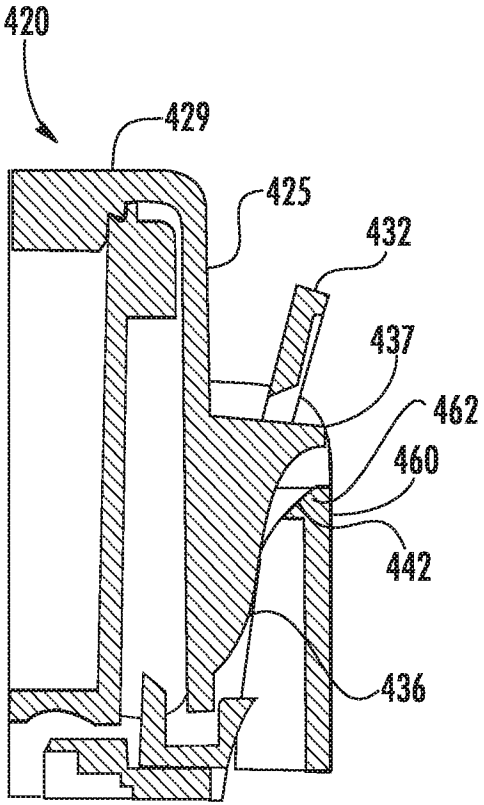

FIG. 13 is a fragmentary sectional view of the example printing material supply of FIG. 8 during insertion into the example printer printing material supply bay.

Figure 14:
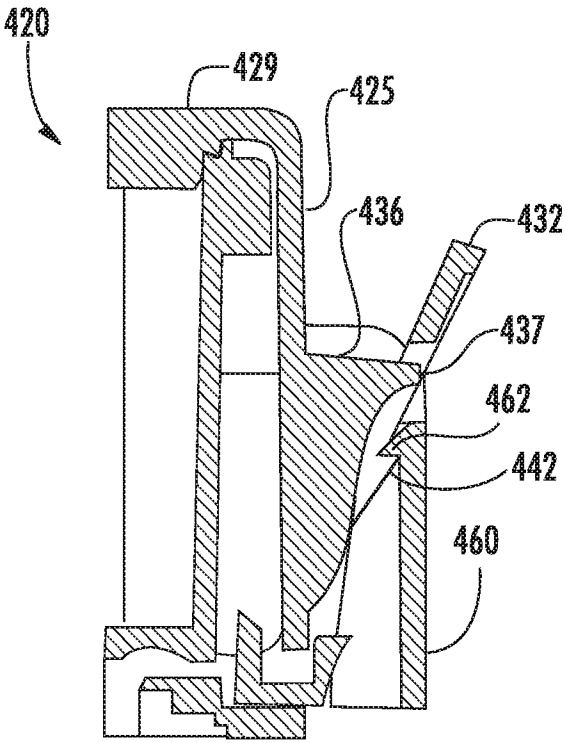

FIG. 14 is a fragmentary sectional view of the example printing material supply of FIG. 8 upon being inserted into the example printer printing material supply bay.

Figure 15:
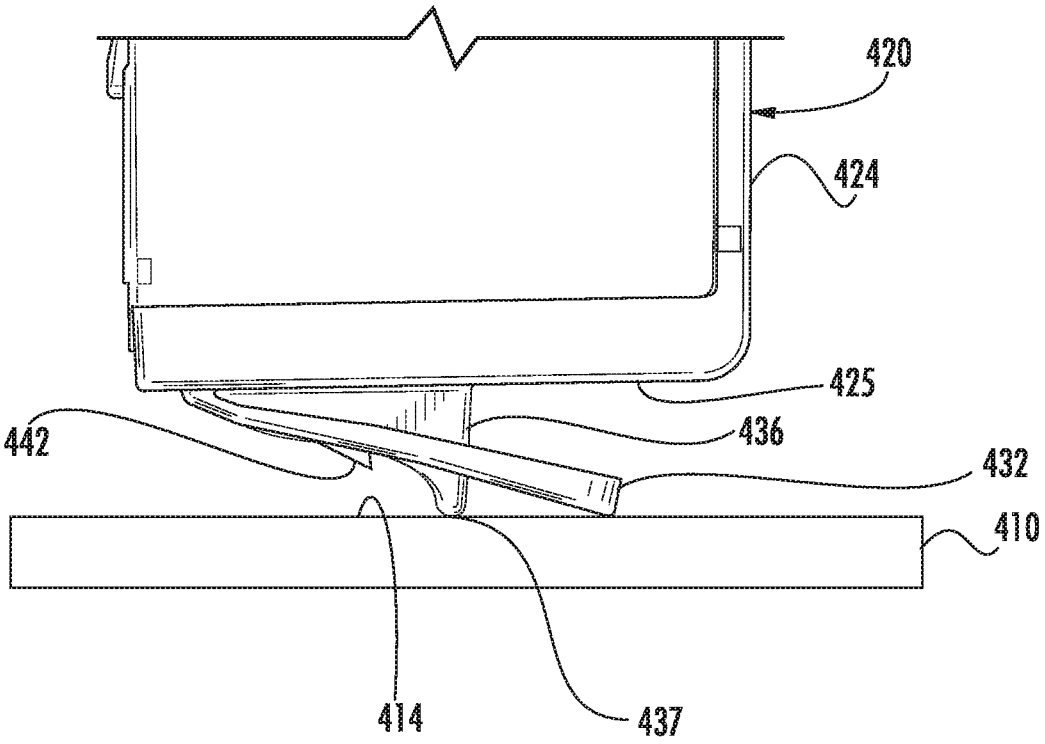

FIG. 15 is a fragmentary sectional view illustrating the example printing material supply of 8 positioned within an example packaging.

Figure 16:
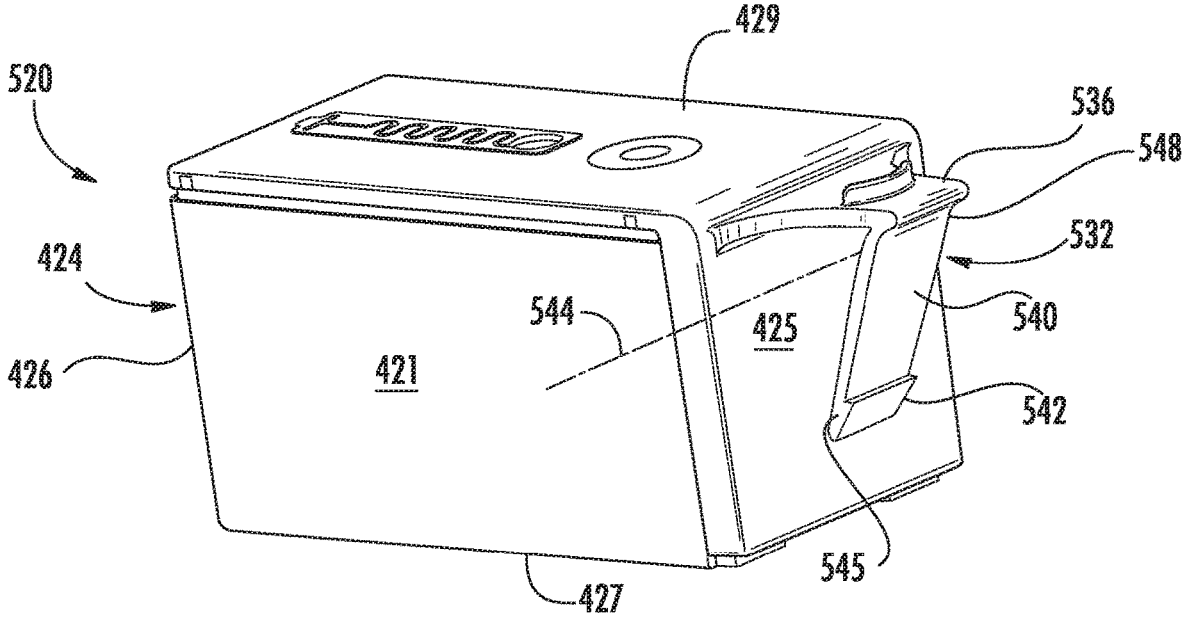

FIG. 16 is a front perspective view of another example printing material supply.

Figure 17:
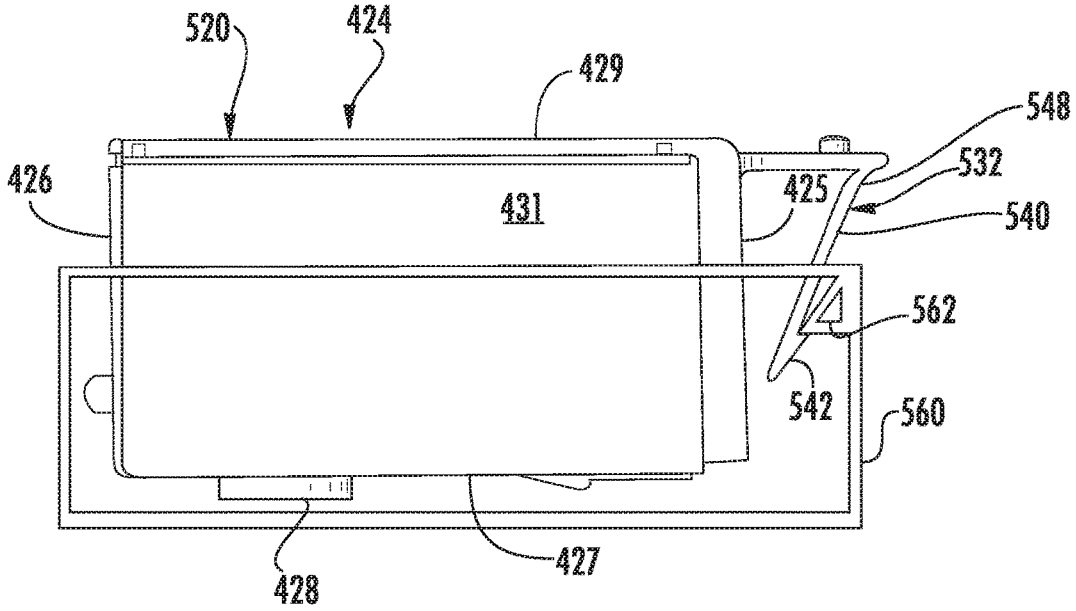

FIG. 17 is a side view of the example printing material supply of FIG. 16 positioned within an example printer printing material supply bay.

Figure 18:
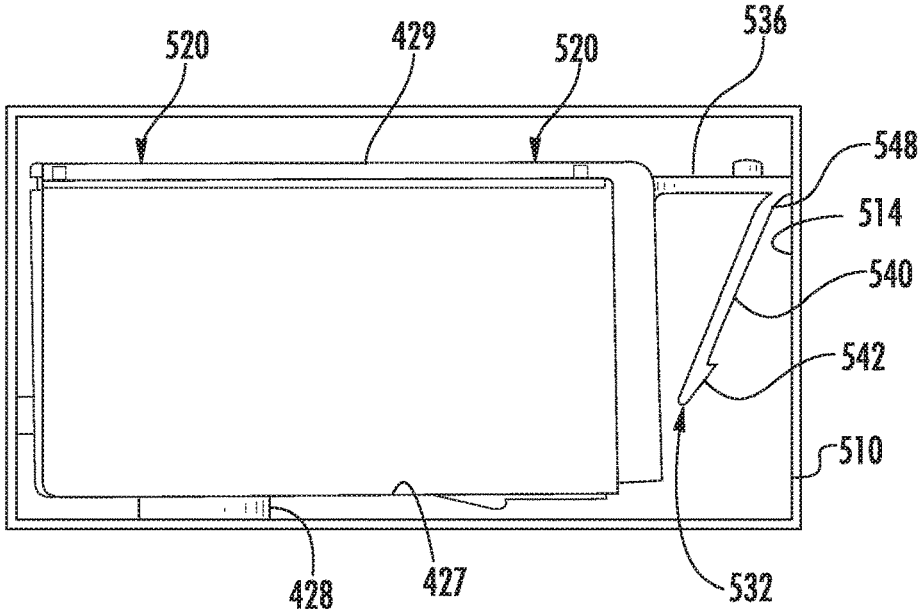
Figure 19:
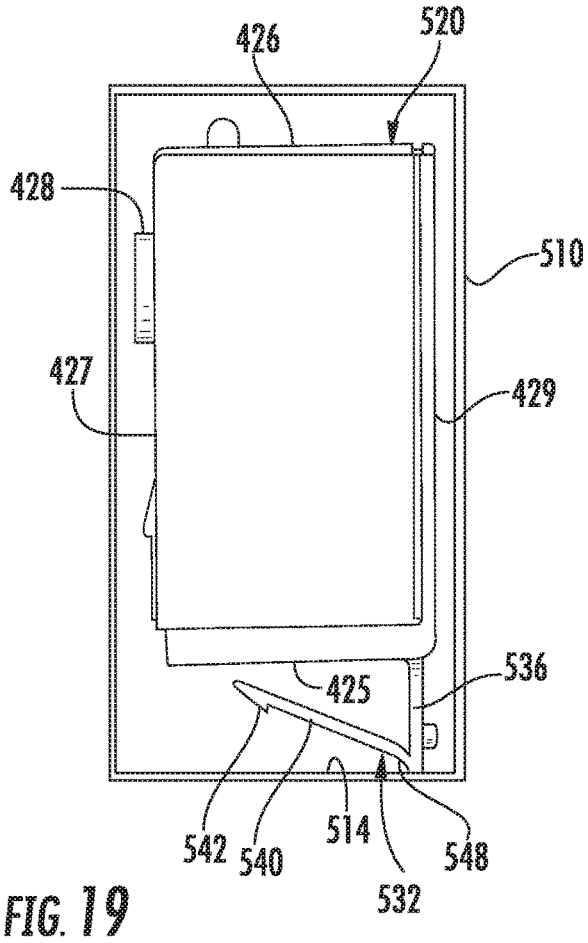

FIGS. 18 and 19 are side views illustrating the example printing material supply of FIG. 16 in an example packaging.

DETAILED DESCRIPTION OF EXAMPLES

The present disclosure describes a printing material supply that utilizes a latch to removably retain the printing material supply in place with respect to a printer. The latch is pivotally coupled to a body of the supply by living hinge. For purposes of this disclosure, a living hinge comprise a flexure bearing integrally formed as a single unitary body and from the same or similar materials as the two rigid pieces it connects.

Although such living hinges may facilitate a lower cost and less complex printing material supply, such living hinges may be subject to creep, wherein after prolonged flexing of the latch about the living hinge, the latch may not fully resiliently return to its original or intended shape or angle. Many existing ink supplies have latches that experience such creep when packaged and during shipping and/or storage. During shipping and/or storage, the latch may bear against the packaging or vice versa subjecting the latch to prolonged periods of flexing or bending of the latch about the living hinge. The resulting creep may interfere with subsequent use of the latch when retaining the printing material supply in a bay or dock of a printer.

The printing material supply of the present disclosure addresses the issue of creep by including a latch protector as part of the printing material supply. The latch protector serves as a packaging standoff, contacting those surfaces of the packaging that bear against the latch to limit the degree that the latch may flex about its living hinge when bearing against the package.

Figure 1:
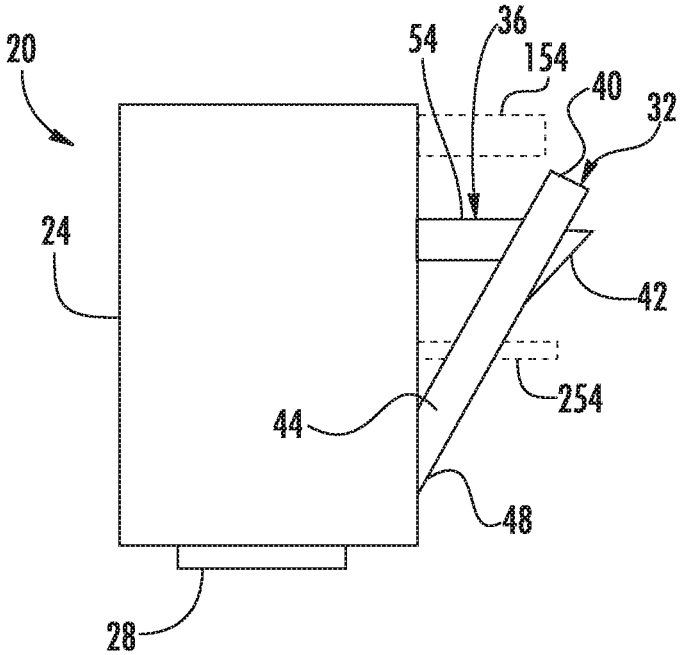
FIG. 1 is a side view schematically illustrating an example printing material supply.
Figure 2:
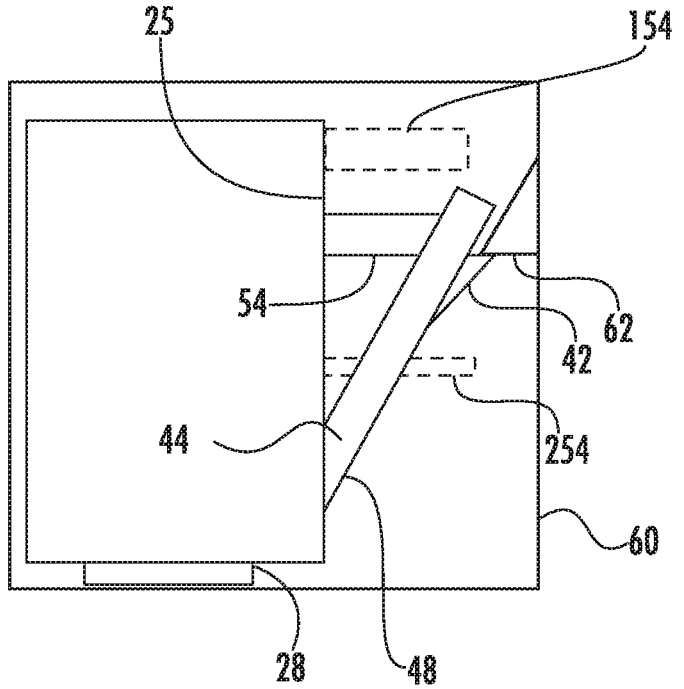
FIG. 2 is a sectional view illustrating the example printing material supply of 1 positioned within an example printer printing material supply bay.
Figure 3:
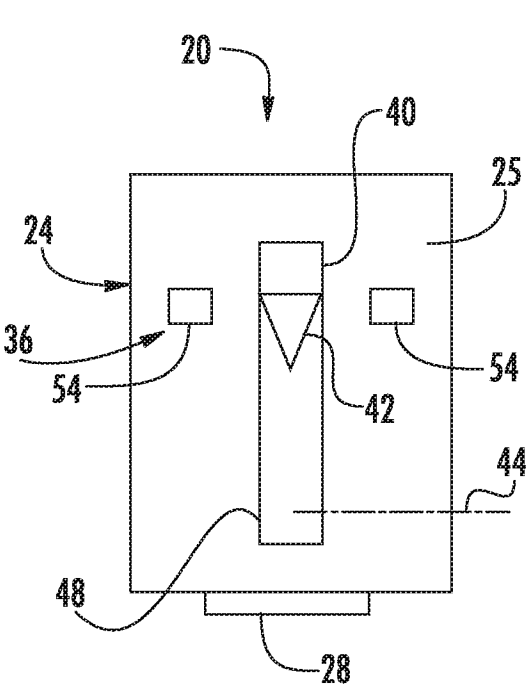
FIG. 3 is a front view of another example printing material supply.

FIGS. 1-3 schematically illustrate an example printing material supply 20. Printing material supply 20 comprises a latch to assist in retaining the supply in a printer or a bay of a printer when being utilized. Although the latch pivots or flexes about a living hinge, printing material supply 20 addresses the issue of creep with a latch protector that is provided as part of supply 20. Printing material supply 20 comprises body 24, dispensing opening 28, latch 32 and latch protector 36.

Body 24 comprises a structure that forms an enclosed volume for containing printing material of a printer. In one implementation, body 24 may be utilized to contain a liquid printing material, such as an ink for printing images or various materials for three-dimensional printing. In one implementation, body 24 may be utilized to contain a solid printing material, such as a powder or other dry forms of printing material.

Dispensing opening 28 constitutes at least one opening or port through which printing material contained within body 24 is dispensed. In one implementation, dispensing opening 28 comprises a port through which the printing material within body 24 is supplied to remote printing elements, wherein the printing element is not carried, supported or provided by supply 20. In another implementation, dispensing opening 28 comprises multiple nozzle openings through which the printing material is selectively ejected to carry out printing. For example, in one implementation, dispensing opening 28 may be provided as part of a print head secured to body 24. Although dispensing opening 28 is illustrated as being located on a bottom face of body 24, in other implementations, dispensing opening 28 may be provided along the sides or top of body 24, depending upon how the printing material is to be dispensed from body 24.

Latch 32 comprises an elongate bar or arm 40 having a catch 42 and being pivotable towards and away from sides of body 24 about a general axis 44 utilizing a living hinge 48. In the example illustrated, arm 40 is integrally formed as part of a single unitary body with at least portions of body 24, forming living hinge 48 that extends between body 24 and the extremities of arm 40. Catch 42 comprise a hook or other projection that interacts with a corresponding catch or hook in a printer or in a bay (also referred to as a dock) of a printer to position and retain supply 20 in place.

Living hinge 48 comprises a flexure bearing formed from a resiliently flexible material and sized or dimensioned so as to allow the outer extremities of arm 40, carrying catch 42, to resiliently flex and pivot between a latched state in which catch 42 interacts with the corresponding catch of the printer receiving bay and an unlatched state. In the example illustrated, living hinge 48 is formed from a polymer such as polypropylene. In other implementations, living hinge 48 may be formed from other polymers or other material including, but not limited to, acrylonitrile butadiene styrene (ABS), polysulfone, polyethylene terephthalate (PET), Nylon, and polyethylene.

In the example illustrated, arm 40 of latch 32 extends from body 24 such that catch 42 is above horizontal axis 44 and above living hinge 48, wherein arm 40 projects upwardly from hinge 48 in a direction away from dispensing opening 28 along the bottom of supply 20. As a result, a user may contact, press and manipulate the outer extremity of arm 40 to pivot the outer extremity of arm 40 towards body 24 and to disengage catch 42 from the corresponding catch of the printer supply bay, allowing supply 20 to be withdrawn from the printer supply bay. In other implementations, arm 40 of latch 32 may alternatively extend at a downward angle, towards the bottom of body 24 and towards dispensing opening 28 on the bottom of body 24, wherein other mechanism provided for facilitating pivoting of arm 40 or otherwise releasing catch 42 when supply 20 is to be removed from the printer supply bay. In yet other implementations, arm 40 of latch 32 may alternatively extend from body 24 sideways or at an angle oblique to the top of body 24, wherein other mechanisms are provided for facilitating the pivoting of arm 40 or otherwise releasing catch 42 when supply 20 is to be removed from the printer supply bay.

FIG. 2 is a sectional view illustrating supply 20 removably positioned within a printer bay 60 having an internal catch 62. During insertion of supply 20 into printer bay 60, arm 40 and catch 42 of latch 32 resiliently flex and pivot towards face 25 of body 24 about the general axis 44 provided by living hinge 48 as catch 42 is moved along and in contact with the upper surface of catch 62. As shown by FIG. 2, once sufficiently inserted into printer bay 60, arm 40 and catch 42 resiliently return to their default position, resiliently flexing and pivoting away from face 25 of body 24 about the general axis 44 provided by living hinge 48. Upon arm 40 and catch 42 returning to the default position, the upper surface of catch 42 resides below the lower surface of catch 62. Absent arm 40 being pinched or squeezed towards face 25 of body 24, catch 42 contacts and interacts with catch 62 to vertically retain supply 20 within bay 60.

Latch protector 36 comprises at least one packaging standoff, such as a bar, arm, post or other projection or protuberance that extends beyond face 25 of body 24 in the same direction that the outer extremities arm 40 are spaced from face 25 of body 24. Latch protector 36 has a rigidity or stiffness greater than that of arm 40 at living hinge 48. Latch protector 36 projects a sufficient distance from face 25 of body 24 so as to limit the extent that arm 40 of latch 32 may pivot or flex towards body 24 when bearing against the sides or other internal surfaces of packaging. Latch protector 36 limits the extent that arm 40 of latch 32 may pivot towards body 24 to a degree such that prolonged exposure to such limited flexing does not result in creep of latch 32.

The degree to which arm 40 of latch 32 may pivot towards body 24 for prolonged periods of time without experiencing creep may vary depending upon the materials, shape and size of those portions of arm 40 forming living hinge 48. In one implementation in which living hinge 48 is formed from polypropylene and has a cross-sectional area of 7.2 $mm^2$, latch protector 36 limits flexing and pivoting of latch 32 about living hinge 48 to an angle of no less than 16 degrees with respect to face 25 of body 24. In one implementation, living hinge 48 allows latch 32 to flex and pivot towards face 25 of body 24 no greater than 11 degrees, until latch protector 36 inhibits any further flexing and pivoting towards face 25 of body 24. In one implementation, living hinge 48 allows latch 32 to flex and pivot towards face 25 of body 24 by no greater than 5 mm towards face 25 of body 24 (as measured in a direction perpendicular to face 25) until latch protector 36 inhibits any further flexing or pivoting towards face 25 of body 24. In other implementations, latch protector 36 may limit such flexing and pivoting of arm 40 about living hinge 48 to other extents depending upon the properties of living hinge 48.

Latch protector 36 is located and sized so as to not interfere with the pivoting of latch 32 when inserted into printer bay 60 and so as to not interfere with the interaction between catch 42 and catch 62. In the example illustrated in FIG. 3, latch protector 36 comprises a pair of projections 54 extending from face 25 on opposite sides of arm 40. Projections 54 have locations relative to arm 40 and catch 42 so as to not interfere with the flexing of arm 40 during insertion of supply 20 into bay 60 and so as to not interfere with the interaction between catches 42 and 62.

Figure 4:
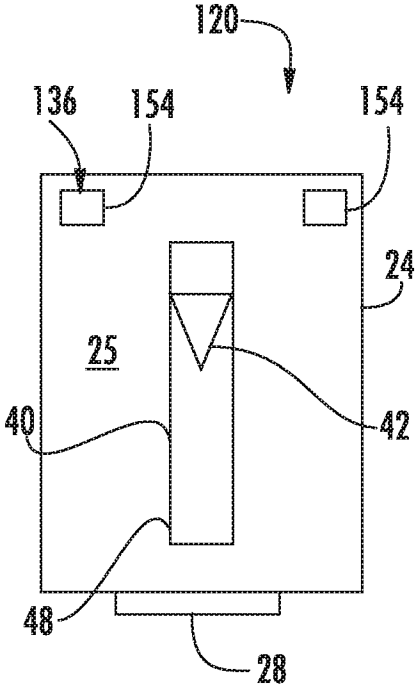
FIG. 4 is a front view of another example printing material supply.

FIG. 4 schematically illustrates printing material supply 120, another implementation of printing material supply 20. Printing material supply 120 is similar to printing material supply 20 except that printing material supply 120 comprises latch protector 136 in lieu of latch protector 36. Latch protector 136 comprises two spaced projections 154 (shown in FIG. 4 and shown with broken lines in FIGS. 1 and 2). Like projections 54 of protector 36, projections 154 comprises extend beyond face 25 of body 24 in the same direction that the outer extremities of arm 40 are spaced from face 25 of body 24. Projections 154 have a rigidity or stiffness greater than that of arm 40 at living hinge 48. Projections 154 project a sufficient distance from face 25 of body 24 so as to limit the extent that arm 40 of latch 32 may pivot or flex towards body 24 when bearing against the sides or other internal surfaces of packaging. Projections 154 limit the extent that arm 40 of latch 32 may pivot towards body 24 to a degree such that prolonged exposure to such limited flexing does not result in creep of latch 32.

In the example illustrated, projections 154 are located above the upper outer extremity of arm 40. Because projections 154 are spaced on opposite sides of arm 40, a user is still provided access to arm 40 to manually pinch or squeeze arm 40 to disengage catch 42 from catch 62 to withdraw supply 20 from supply bay 60 (shown in FIG. 2). Although latch protector 136 is illustrated as comprising a pair of spaced projections 154, in other implementations, latch protector 136 as well as latch protector 36 may alternatively comprise a single projection or greater than two of such projections.

Figure 5:
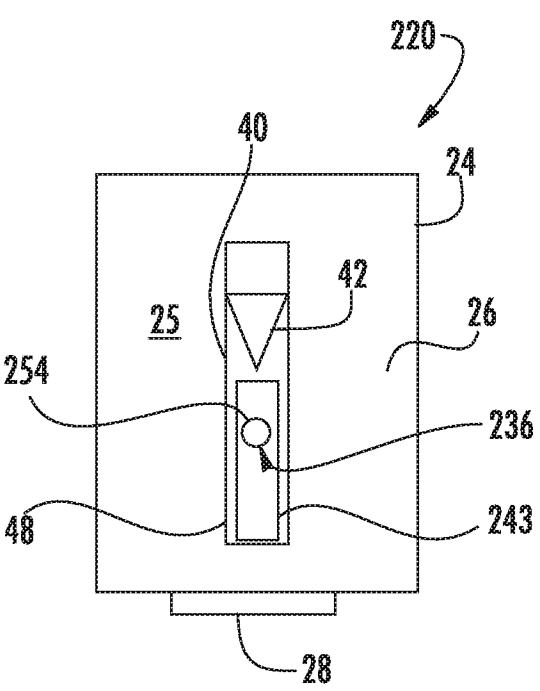
FIG. 5 is a front view of another example printing material supply.

FIG. 5 schematically illustrates printing material supply 220, another variation upon printing material supply 20. Printing material supply 220 is similar to printing material supply 20 except that printing material supply 220 comprises latch protector 236 in lieu of latch protector 36. Latch protector 236 comprises a rod, shaft or other projection 254 extending from face 25 through an opening 243 in arm 40. Like projections 54 of protector 36, projection 254 extends beyond face 25 of body 24 in the same direction that the outer extremities of arm 40 are spaced from face 25 of body 24. Projection 254 has a rigidity or stiffness greater than that of arm 40 at living hinge 48. Projection 254 projects a sufficient distance from face 25 of body 24 so as to limit the extent that arm 40 of latch 32 may pivot or flex towards body 24 when bearing against the sides or other internal surfaces of packaging. Projection 254 limits the extent that arm 40 of latch 32 may pivot towards body 24 to a degree such that prolonged exposure to such limited flexing does not result in creep of latch 32.

Because projection 254 extends through opening 243 in arm 40, projection 254 is more centrally located with respect to arm 40, along a centerline of arm 40. As a result, projection 254 may more reliably engage those surfaces of a package that might otherwise bear against arm 40. Because projection 254 extends through opening 243 in arm 40, projection 254 is less likely to interfere with manual grasping and pinching of arm 40 by user to disengage catch is 42 and 62 for the withdrawal of supply 20 from bay 60 (shown in FIG. 2).

Although latch protector 236 is illustrated as comprising a single projection 254, in other implementations, latch protector 236 may comprise multiple projections projecting through a single opening or multiple openings extending through arm 40. In some implementations, arm 40 may include notches in the side of arm 40 through each of which a projection 254 extends. In some implementations, latch protector 236 of supply 220 may comprise additional projections or package standoffs such as projections 54 and/or 154 described above. Such additional projections may provide face 25 of body 24 with a large array of multiple projections that extends on all sides of latch 32, more reliably contacting a package surface and more reliably preventing the package surface from unduly flexing arm 40 for prolonged periods of time.

Figure 6:
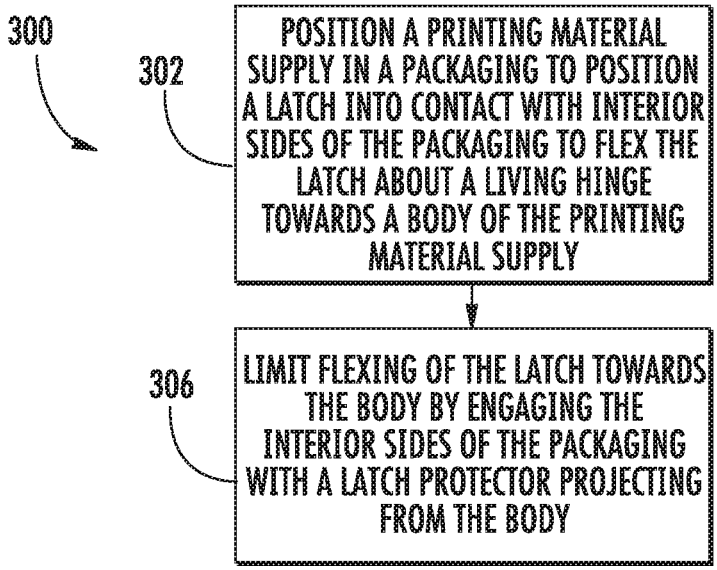
FIG. 6 is a flow diagram of an example method for packaging a printing material supply.
Figure 7:
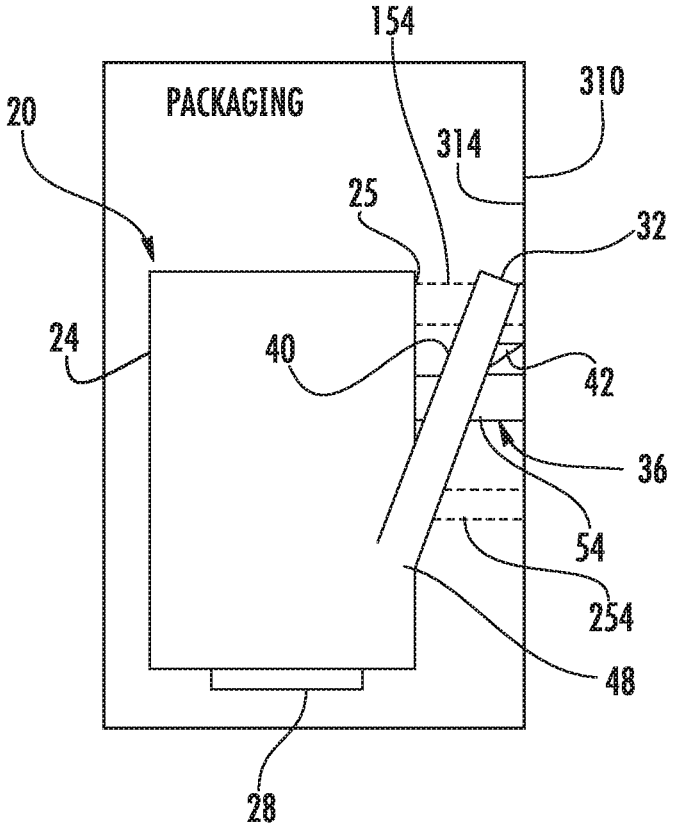
FIG. 7 is a sectional view illustrating the example printing material supply of 1 within an example packaging.

FIG. 6 is a flow diagram of an example method 300 for packaging a printing material supply for storage or shipment. FIG. 7 illustrates one example in which supply 20 is positioned within an example package 310 pursuant to method 300. Although method 300 is described with respect to the packaging of supply 20 and the illustrated example packaging 310, it should be appreciated that method 300 may be carried out with various other packaging constructions and may be utilized to package any of a variety of differently shaped and sized printing material supplies having any of the above described latch protectors or any of the latch protectors described hereafter.

As indicated by block 302, printing material supply 20 is positioned within packaging 310 to position latch 32 into contact with the interior sides or side surfaces 314 of packaging 310 to flex and pivot latch 32 about living hinge 48 towards face 25 of body 24. As indicated by block 306, the flexing and pivoting of latch 32 about living hinge 48 towards face 25 of body 24 of supply 20 is limited by engaging the interior sides 314 of packaging 310 with a latch protector such as latch protector 36 or with another latch protector such as latch protector 136 or 236 described above.

As shown by FIG. 7, prior to latch 32 pivoting towards body 24 by an unacceptable degree or amount, projections 54 of latch protector 36 are brought into contact with interior surfaces 314 of packaging 310. As a result, projections 54 of latch protector 36 inhibit such side walls of package 310 further pivoting arm 40 towards body 24. Any such pivoting and flexing of arm 40 towards body 24 for prolonged periods of time during shipping and storage is to a limited extent, a limited extent that is acceptable and will not produce an unacceptable amount or degree of creep of arm 40 that would be detrimental to the performance of latch 32 when supply 20 is removed from packaging 320 and utilized in a printer.

FIGS. 8-11 illustrates an example printing material supply 420. Printing material supply comprises body 424, printing material dispensing outlet 428, latch 432 and a latch protector 436. Body 424 comprises a structure that forms an enclosed volume for containing printing material of a printer. In one implementation, body 424 may be utilized to contain a liquid printing material, such as an ink for printing images or various materials for three-dimensional printing. In one implementation, body 424 may be utilized to contain a solid printing material, such as a powder or other dry form of printing material. In the example illustrated, body 424 is generally rectangular, having opposite end faces 425, 426, the bottom 427, a top 429 and opposing sides 431. In other implementations, body 424 may have other sizes, shapes and proportions.

Dispensing opening 428 constitutes at least one opening or port through which printing material contained within body 424 is dispensed. In the example illustrated, dispensing opening 428 comprises a port through which the printing material within body 424 is supplied to remote printing elements, printing element is not carried, supported are provided by supply 420. In another implementation, dispensing opening 428 comprises multiple nozzle openings through which the printing material is selectively ejected to carry out printing. For example, in one implementation, dispensing opening 428 may be provided as part of a print head secured to body 424. Although dispensing opening 428 is illustrated as being located on a bottom face of body 424, in other implementations, dispensing opening 428 may be provided along the sides or top of body 424, depending upon how the printing material is to be dispensed from body 424.

Latch 432 comprises an elongate bar or arm 440 having first and second catches 442 located on opposite sides of an opening, shown as an elongate slot 443, extending through arm 440. Arm 440 is pivotable towards and away from face 425 of body 424 about a general axis 444 utilizing a living hinge 448. In the example illustrated, arm 440 is integrally formed as part of a single unitary body with at least portions of body 424, forming living hinge 448 that extends between body 424 and the extremities of arm 440. Catches 442 extend on opposite sides of slot 443, each of catches 442 comprising a hook or other projection that interacts with a corresponding catch or hook in a printer or in a bay of a printer to position and retain supply 420 in place.

Living hinge 448 comprises a flexure bearing formed from a resiliently flexible material and sized or dimensioned so as to allow the outer extremities of arm 440, carrying catches 442, to resiliently flex and pivot between a latched state in which catch 442 interacts with the corresponding catch of the printer receiving bay and unlatched state. In the example illustrated, living hinge 448 is formed from a polymer such as polypropylene. In other implementations, living hinge 448 may be formed from other polymers or other material including, but not limited to, acrylonitrile butadiene styrene (ABS), polysulfone, polyethylene terephthalate (PET), Nylon, and polyethylene.

FIG. 10A is a sectional view illustrating living hinge 448. As shown by FIG. 10A, the upper face portion of latch 432, above catches 442, comprises stiffening ribs 445, inhibiting deflection or bending of the upper face portion of latch 432 above catches 442. The region of latch 432 below catches 442, extending between catches 442 and face 425 of body 424, omits such ribs and has a reduced transverse width as well as a reduced overall thickness to form living hinge 448. In one implementation, the regions forming living hinge 448 have a cross-sectional area of approximately 7.16 $mm^2$. In other implementations, the cross-sectional area may have other values depending upon the characteristic of the material forming living hinge 448.

In the example illustrated, arm 440 of latch 432 extends from body 424 such that catches 442 are above horizontal axis 444 and above living hinge 448, wherein arm 440 projects upwardly from hinge 448 in a direction away from dispensing opening 428 along the bottom of supply 420. As a result, a user may contact, press and manipulate the outer extremity of arm 440 to pivot the outer extremity of arm 440 towards body 424 and to disengage catch 442 from the corresponding catch of the printer supply bay, allowing supply 420 to be withdrawn from the printer supply bay. Although arm 440 is illustrated as having a completely surrounded and enclosed slot or aperture through which latch projector 436 extends, in other implementations, arm 440 may be split into two side-by-side arm portions separated with an elongate channel, wherein latch protector 436 is located within the elongate channel between the two separate and independent arm portions.

In other implementations, arm 440 of latch 432 may alternatively extend at a downward angle, towards the bottom of body 424 and towards dispensing opening 428 on the bottom of body 424, wherein other mechanism provided for facilitating pivoting of arm 440 or otherwise releasing catch 442 when supply 420 is to be removed from the printer supply bay. In yet other implementations, arm 440 of latch 432 may alternatively extend from body 424 sideways or at an angle oblique to the top of body 424, wherein other mechanisms are provided for facilitating the pivoting of arm 440 or otherwise releasing catch 442 when supply 420 is to be removed from the printer supply bay.

Latch protector 436 comprises at least one packaging standoff, such as a bar, arm, post or other projection or protuberance that extends beyond face 425 of body 424 in the same direction that the outer extremities arm 440 are spaced from face 425 of body 424. Latch protector 436 has a rigidity or stiffness greater than that of arm 440 at living hinge 448. Latch protector 436 projects a sufficient distance from face 425 of body 424 so as to limit the extent that arm 440 of latch 432 may pivot or flex towards body 424 when bearing against the sides or other internal surfaces of packaging. Latch protector 436 limits the extent that arm 440 of latch 432 may pivot towards body 424 to a degree such that prolonged exposure to such limited flexing does not result in creep of latch 432.

The degree to which arm 440 of latch 432 may pivot towards body 424 for prolonged periods of time without experiencing creep may vary depending upon the materials, shape and size of those portions of arm 440 forming living hinge 448. In one implementation in which living hinge 448 is formed from polypropylene and has a cross-sectional area of 7.2 $mm^2$, latch protector 436 limits flexing and pivoting of latch 432 about living hinge 448 to an angle of no less than 16 degrees with respect to face 425 of body 424. In other implementations, latch protector 46 may limit such flexing and pivoting of arm 440 about living hinge 448 to other extents depending upon the properties of living hinge 448.

Latch protector 436 is located and sized so as to not interfere with the pivoting of latch 432 when inserted into a printer bay and so as to not interfere with the interaction between catch 442 and the catch of the printer bay corresponding to catch 442. In the example illustrated, latch protector 436 comprises a triangular projection integrally formed as part of a single unitary body with face 425 of body 424 and aligned with slot 443 so as to be passable through slot 443 when arm 440 is flexed and pivoted towards face 425 of body 424. The triangular shape of latch projector 436 provides latch projector 436 which additional strength and rigidity, inhibiting latch protector 436 from breaking when experiencing loads when supply 420 is packaged. Latch protector 436 projects upwardly away from face 425 of body 424 so as to contact the interior sides of packaging, but is located so as to not interfere with the flexing of arm 440 during insertion of supply 420 into a package and so as to not interfere with the interaction between catch 442 and the internal catch of the package.

FIG. 12 is a fragmentary perspective view illustrating printing material supply 420 positioned within an example printer supply bay 460. FIG. 13 is a sectional view illustrating the pivoting of latch 432 towards face 425 of body 424 as catch 442 rides along a corresponding catch 462 along the interior of bay 460. FIG. 14 is a sectional view illustrating printing material supply 420 sufficiently inserted into the example printer bay 460 such that arm 440 and catch 442 resiliently return to their default position, resiliently flexing and pivoting away from face 425 of body 424 about the general axis 444 provided by living hinge 448. As a result, the upper surface of catch 42 resides below the lower surface of catch 462. Absent arm 440 being pinched or squeezed towards face 425 of body 424, catch 442 contacts and interacts with catch 462 to vertically retain supply 420 within bay 460.

FIG. 15 is a sectional view illustrating printing material supply 420 positioned within a packaging 410 having an interior surface 414 that extends opposite to latch 432 and latch protector 436. As shown by FIG. 15, in response to contacting interior surface 414, latch 432 pivots and flexes towards face 425 of body 424. As latch 432 pivots and flexes towards face 425, the nose 437 of latch protector 436 passes through or further through slot 443. Prior to latch 432 pivoting towards body 424 by an unacceptable degree or amount, latch protector 436 is brought into contact with interior surfaces 414 of packaging 410. As a result, latch protector 36 inhibits such side walls of package 410 further pivoting arm 440 towards body 424. Any such pivoting and flexing of arm 440 towards body 424 for prolonged periods of time during shipping and storage is to a limited extent, a limited extent that is acceptable and will not produce an unacceptable amount or degree of creep of arm 440 that would be detrimental to the performance of latch 432 when supply 420 is removed from packaging 410 and utilized in a printer.

FIG. 16 illustrates an example printing material supply container 520. Printing material supply 520 is similar to printing material supply 420 except that printing material supply 520 comprises latch 532 and latch protector 536 in place of latch 432 and latch protector 436, respectively. Those remaining components of supply 520 that correspond to components of supply 420 are numbered similarly.

Latch 532 comprises an elongate bar or arm 540 having a catch 542 and being pivotable towards and away from sides of body 424 about a general axis 544 utilizing a living hinge 548. In the example illustrated, arm 540 is integrally formed as part of a single unitary body with at least portions of body 424, forming living hinge 548 that extends between latch protector 536 and the extremities of arm 540. Catch 542 comprise a hook or other projection that interacts with a corresponding catch or hook in a printer or in a bay of a printer to position and retain supply 520 in place.

Living hinge 548 comprises a flexure bearing formed from a resiliently flexible material and sized or dimensioned so as to allow the outer extremities of arm 540, carrying catch 542, to resiliently flex and pivot between a latched state in which catch 542 interacts with the corresponding catch of the printer receiving bay and unlatched state. In the example illustrated, living hinge 548 is formed from a polymer such as propylene. In other implementations, living hinge 48 may be formed from other polymers or other material including, but not limited to, acrylonitrile butadiene styrene (ABS), polysulfone, polyethylene terephthalate (PET), Nylon, and polyethylene.

In the example illustrated, arm 540 of latch 532 hangs from the projection of latch protector 536 such that catch 542 is below the horizontal axis 544 and above living hinge 548, wherein arm 540 hangs downwardly from hinge 548 in a direction away from dispensing opening 28 and towards face 425 such that latch protector 536 projects further away from face 425 than the underlying arm 540 and catch 545.

FIG. 17 is a sectional view illustrating supply 520 removably positioned within an example, schematically illustrated, printer bay 560 having an internal catch 562. During insertion of supply 520 into printer bay 560, arm 540 and catch 542 of latch 532 resiliently flex and pivot towards face 425 of body 424 about the general axis 544 provided by living hinge 548 as catch 42 is moved along and in contact with the upper surface of catch 562. As shown by FIG. 17, once sufficiently inserted into printer bay 560, arm 540 and catch 542 resiliently return to their default position, resiliently flexing and pivoting away from face 425 of body 424 about the general axis 544 provided by living hinge 548. This results in the upper surface of catch 542 residing below the lower surface of catchy 62. Absent arm 540 being pinched or squeezed towards face 425 of body 424, catch 542 contacts and interacts with catch 562 to vertically retain supply 520 within bay 60.

Latch protector 536 comprises at least one packaging standoff, such as a bar, arm, post or other projection or protuberance that extends beyond 425 of body 424 further away from face 425 than arm 540. In the example illustrated, latch protector 536 horizontally extends from face 45, parallel to the bottom 427 and the top 429 of body 424. In other implementations, the projection or arm of latch protector 536 may extend at other angles from face 425, wherein latch protector 536 extends further outwardly beyond face 425 as compared to the underlying arm 540 of latch 532.

Latch protector 536 has a rigidity or stiffness greater than that of arm 540 at living hinge 548. Latch protector 536 projects a sufficient distance from face 425 of body 424 so as to limit the extent that arm 540 of latch 532 may pivot or flex towards body 424 when bearing against the sides or other internal surfaces of packaging. In the example illustrated, latch protector 536 inhibits packaging from contacting or bearing against latch 532. At the same time, latch protector 536 is located and sized so as to not interfere with the pivoting of latch 532 when inserted into printer bay 560 and so as to not interfere with the interaction between catch 542 and catch 562.

FIGS. 18 and 19 are sectional view illustrating printing material supply 520 positioned within a packaging 510 having an interior surface 514 that extends opposite to latch 532 and latch protector 536. As shown by FIGS. 18 and 19, when supply 520 is inserted within packaging 510, latch protector 536 abuts interior surfaces 514 while latch 532 hangs underneath latch protector 536. Latch protector 536 does not flex or bend or flex or bend to a limited extent such that latch FIG. 536 may resiliently return to its initial or near initial shape without experiencing creep. As a result, latch protector 536 inhibits such side walls of package 510 bearing against and pivoting arm 540 towards body 424, preventing creep that would be detrimental to the performance of latch 532 when supply 520 is removed from packaging 510 and utilized in a printer.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A printing material supply comprising:

a body having a printing material dispensing opening;

a latch pivotably coupled to the body by a living hinge extending from a first end of the latch, the latch having a distal tip at a second end of the latch; and a latch protector comprising a structure coupled to and projecting from the body between the living hinge and the distal tip of the latch so as to contact a packaging surface of a package to inhibit creep of the latch about the living hinge when the printing material supply is contained within the packaging.

2. The printing material supply of claim 1, wherein the latch projector projects from the body and wherein the latch is suspended from the latch protector.

3. The printing material supply of claim 1, wherein the latch protector projects from the body towards the latch.

4. The printing material supply of claim 1, wherein the latch comprises a hook below the living hinge.

5. The printing material supply of claim 1, wherein the latch comprises a hook above the living hinge.

6. The printing material supply of claim 1, wherein the latch comprises:

a hook; and an arm supporting the hook and pivotably coupled to the body by the living hinge, the arm having a slot aligned with the latch protector and receiving the latch protector during pivoting of the arm.

7. The printing material supply of claim 1, when the latch comprises a first arm pivotably coupled to the body on a first side of the latch protector by the living hinge, the first arm supporting a first hook.

8. The printing material supply of claim 7 further comprising a second arm pivotably coupled to the body on a second side of the latch protector by a second living hinge, the second arm supporting a second hook.

9. The printing material supply of claim 1, wherein the latch has a latch tip, wherein the latch protector has a protector tip and wherein the latch tip is pivotable towards the body by no greater than 11 degrees until the latch tip is closer to the body than protector tip.

10. The printing material supply of claim 1, wherein the latch has a latch tip spaced from the body by a spacing, wherein the latch protector has a protector tip and wherein the latch tip is pivotable towards the body by no greater than 35 percent of the spacing until the latch tip is closer to the body than protector tip.

11. The printing material supply of claim 1, wherein the latch protector comprises a pair of spaced projections projecting from the body on opposite sides of the latch.

12. A method comprising:

positioning a printing material supply in a packaging to position a latch into contact with interior sides of a packaging to flex the latch about a living hinge towards a body of the printing material supply; and limiting flexing of the latch towards the body by engaging the interior sides of the packaging with a latch protector projecting from the body and wherein the latch is suspended from the latch protector.

13. A print cartridge supply comprising:

a body to contain a printing material;

a latch comprising:

an arm coupled to the body and pivotable about a living hinge, the arm comprising a slot; and a hook; and a latch protector extendable through the slot to contact a packaging surface of a package during flexing of the arm to inhibit creep of the latch about the living hinge when the print cartridge supply is contained within the package.

* * * * *